US012673761B2

(12) United States Patent
Achard et al.

(10) Patent No.: US 12,673,761 B2
(45) Date of Patent: Jul. 7, 2026

(54) RANGE EFFICIENCY OF WATERCRAFT

(71) Applicant: TAIGA MOTORS INC., Lasalle (CA)

(72) Inventors: Paul Achard, Montreal (CA); Clovis Roy-Bernier, Montreal (CA)

(73) Assignee: TAIGA MOTORS INC., Lasalle (CA)

( * ) Notice: Subject to any disclaimer, the term of this patent is extended or adjusted under 35 U.S.C. 154(b) by 1056 days.

(21) Appl. No.: 17/843,002

(22) Filed: Jun. 17, 2022

(65) Prior Publication Data

US 2023/0011707 A1 Jan. 12, 2023

Related U.S. Application Data

(60) Provisional application No. 63/219,574, filed on Jul. 8, 2021.

(51) Int. Cl.

| | |
|---|---|
| ***B63H 21/22*** | (2006.01) |
| ***B63B 34/10*** | (2020.01) |
| ***B63H 21/21*** | (2006.01) |

(52) U.S. Cl.

CPC ..... *B63H 21/22* (2013.01); *B63B 34/10* (2020.02); *B63H 21/21* (2013.01); *B63H 2021/216* (2013.01)

(58) Field of Classification Search

CPC ..... B63B 34/10; B63H 21/21; B63H 21/22; B63H 2021/216

See application file for complete search history.

(56) References Cited

U.S. PATENT DOCUMENTS

| | | | | |
|---|---|---|---|---|
| 5,209,682 | A * | 5/1993 | Duning | G05D 1/0206 73/178 R |
| 6,223,712 | B1 * | 5/2001 | Montgomery | F02B 61/045 123/195 R |
| 6,508,680 | B2 * | 1/2003 | Kanno | F02D 41/0005 440/87 |
| 6,848,956 | B2 * | 2/2005 | Ozawa | F02B 61/045 440/1 |
| 6,884,128 | B2 * | 4/2005 | Okuyama | F02D 31/006 440/1 |
| 7,422,495 | B2 * | 9/2008 | Kinoshita | B63H 21/213 440/3 |

(Continued)

FOREIGN PATENT DOCUMENTS

WO 2020206380 A1 10/2020

*Primary Examiner* — S. Joseph Morano
*Assistant Examiner* — Jovon E Hayes
(74) *Attorney, Agent, or Firm* — Norton Rose Fulbright Canada LLP

(57) ABSTRACT

There is described a watercraft comprising a housing having a hull and a deck, the hull shaped to cause the watercraft to operate in a displacement state and a planing state, a powerplant in the housing, and a propulsion device drivingly engaged to the powerplant to generate a propulsive force to propel the watercraft. A controller is configured for monitoring an operational parameter of the watercraft, the watercraft having a range-efficient operating regime following a transition of the watercraft from the displacement state to the planing state, the operational parameter having an optimal state for the range-efficient operating regime. A user interface is coupled to the controller and configured for providing a visual indication of a status of the watercraft in relation to the range-efficient operating regime.

18 Claims, 11 Drawing Sheets

(56) References Cited

U.S. PATENT DOCUMENTS

| | | | | |
|---|---|---|---|---|
| 7,513,807 | B2 * | 4/2009 | Kinoshita | B63H 21/21 440/2 |
| 7,647,143 | B2 * | 1/2010 | Ito | F02D 31/002 440/2 |
| 2004/0090195 | A1 * | 5/2004 | Motsenbocker | B60L 58/25 318/109 |
| 2004/0242091 | A1 * | 12/2004 | Okuyama | B63H 21/21 440/86 |
| 2007/0021015 | A1 * | 1/2007 | Kinoshita | B63H 21/213 440/1 |
| 2007/0293103 | A1 * | 12/2007 | Kinoshita | F02D 11/02 440/1 |
| 2017/0274972 | A1 * | 9/2017 | Anma | F02D 11/02 |

* cited by examiner

RANGE EFFICIENCY OF WATERCRAFT

CROSS-REFERENCE TO RELATED APPLICATION(S)

This application claims priority from U.S. Provisional Patent Application No. 63/219,574, filed Jul. 8, 2021, which is incorporated by reference in its entirety herein.

TECHNICAL FIELD

The present disclosure generally relate to the field of watercraft, such as personal watercraft and other types of watercraft having outboard motors.

BACKGROUND OF THE ART

Watercraft are vehicles or vessels used on water. Some watercraft comprise a powerplant and a propulsion device drivingly engaged to the powerplant to generate a propulsive force to propel the watercraft. These types of watercraft are limited in range due to various factors, internal and external to the watercraft. Therefore, improvements are needed.

SUMMARY

In accordance with a broad aspect, there is watercraft comprising a housing having a hull and a deck, the hull shaped to cause the watercraft to operate in a displacement state and a planing state, a powerplant in the housing, and a propulsion device drivingly engaged to the powerplant to generate a propulsive force to propel the watercraft. A controller is configured for monitoring an operational parameter of the watercraft, the operational parameter relating to a range-efficient operating regime of the watercraft following a transition of the watercraft from the displacement state to the planing state. A user interface is coupled to the controller and configured for providing a visual indication of a status of the watercraft in relation to the range-efficient operating regime based on the operational parameter.

In some embodiments, the operational parameter has a range of values corresponding to the range-efficient operating regime. Optionally, at least some of the range of values of the operational parameter correspond an optimal state for the range-efficient operating regime.

In some embodiments, the user interface is configured for displaying the monitored operational parameter in relation to the optimal state.

In some embodiments, the operational parameter comprises a speed of the watercraft.

In some embodiments, the powerplant comprises an electric motor and the operational parameter comprises a rotational speed of the electric motor.

In some embodiments, the operational parameter comprises a power to speed ratio (PSR) for the watercraft.

In some embodiments, the operational parameter comprises a first operational parameter and a second operational parameter, and wherein the first operational parameter is a speed of the watercraft and the second operational parameter is a trim angle of a nozzle of the propulsion device.

In some embodiments, the visual indication comprises at least one of a scale, a numerical value, and a dial.

In some embodiments, the visual indication comprises an indicator that is active when the watercraft is operating in the range-efficient operating regime and inactive when the watercraft is operating outside of the range-efficient operating regime.

According to anther broad aspect, there is method of operating a watercraft having a powerplant and a propulsion device drivingly engaged to the powerplant to generate a propulsive force to propel the watercraft, the watercraft having a hull shaped to cause the watercraft to operate in a displacement state and a planing state. The method comprises monitoring an operational parameter of the watercraft, the operational parameter relating to a range-efficient operating regime following a transition of the watercraft from the displacement state to the planing state, and providing, based on the operational parameter, a visual indication on a user interface of the watercraft of a status of the watercraft in relation to the range-efficient operating regime.

In some embodiments, providing the visual indication of the status of the watercraft in relation to the range-efficient operating regime comprises displaying the monitored operational parameter in relation to a range of values of the operational parameter corresponding to the range-efficient operating regime. The method may further include determining the range of values for the operational parameter in relation to the range-efficient operating regime as a function of one or more factor internal or external to the watercraft. The factor external to the watercraft may comprise at least one of a loading of the watercraft, a wind factor, a water current, and a water salinity.

In some embodiments, providing the visual indicator on the user interface comprises activating an indicator when the watercraft is operating in the range-efficient operating regime and deactivating the indicator when the watercraft is operating outside of the range-efficient operating regime.

In some embodiments, providing the visual indicator on the user interface comprises dynamically changing an aspect of the visual indicator proportionally with a change in efficiency of the watercraft.

In some embodiments, the method further comprises controlling the operational parameter when the watercraft is operating in the range-efficient operating regime to remain within the range-efficient operating regime. Controlling the operational parameter may comprise applying a speed limit or activating a cruise control function for the watercraft and/or adjusting a trim angle of a nozzle of the propulsion device.

In accordance with a broad aspect, there is provided a watercraft comprising a housing having a hull and a deck, the hull shaped to cause the watercraft to operate in a displacement state and a planing state, a powerplant in the housing, and a propulsion device drivingly engaged to the powerplant to generate a propulsive force to propel the watercraft. A controller is configured for monitoring an operational parameter of the watercraft, the watercraft having a range-efficient operating regime following a transition of the watercraft from the displacement state to the planing state, the operational parameter having an optimal state for the range-efficient operating regime. A user interface is coupled to the controller and configured for providing a visual indication of a status of the watercraft in relation to the range-efficient operating regime.

In accordance with another broad aspect, a method of operating a watercraft having a powerplant and a propulsion device drivingly engaged to the powerplant to generate a propulsive force to propel the watercraft, the watercraft having a hull shaped to cause the watercraft to operate in a displacement state and a planing state. The method comprises monitoring an operational parameter of the watercraft, the watercraft having a range-efficient operating regime following a transition of the watercraft from the displacement state to the planing state, the operational parameter having an optimal state for the range-efficient operating regime; and providing a visual indication on a user interface of the watercraft of a status of the watercraft in relation to the range-efficient operating regime.

In accordance with yet another broad aspect, a watercraft comprising a housing having a hull and a deck, the hull shaped to cause the watercraft to operate in a displacement state and a planing state, a powerplant in the housing, and a propulsion device drivingly engaged to the powerplant to generate a propulsive force to propel the watercraft. A controller is configured for monitoring an operational parameter of the watercraft to determine when the watercraft is operating within the range-efficient operating regime, and upon determination that the watercraft is operating within the range-efficient operating regime, effecting control of the watercraft to maintain the watercraft within the range-efficient operating regime The features described herein may be used together in any combination. Many further features and combinations thereof concerning embodiments described herein will appear to those skilled in the art following a reading of the instant disclosure.

DESCRIPTION OF THE DRAWINGS

Reference is now made to the accompanying figures in which.

DETAILED DESCRIPTION

The present disclosure relates to watercraft, and to methods and systems for extending and/or optimizing the range of watercraft, and particularly optimizing the range of electric watercraft. The present disclosure is directed to watercraft having a powerplant and a propulsion device drivingly engaged to the powerplant to generate a propulsive force to propel the watercraft. The powerplant may be a traditional combustion engine or an electric motor. The watercraft has a hull designed so as to allow the watercraft to operate in a displacement state, a planing state, and a semi-displacement or semi-planing state (i.e. transition from displacement state to planing state) as will be described in more detail below. Examples of suitable electric watercraft include personal watercraft (PWCs) having a straddle seat for accommodating an operator and optionally one or more passengers. Other watercraft, such as those equipped with an outboard motor, are also applicable.

Figure 1A:
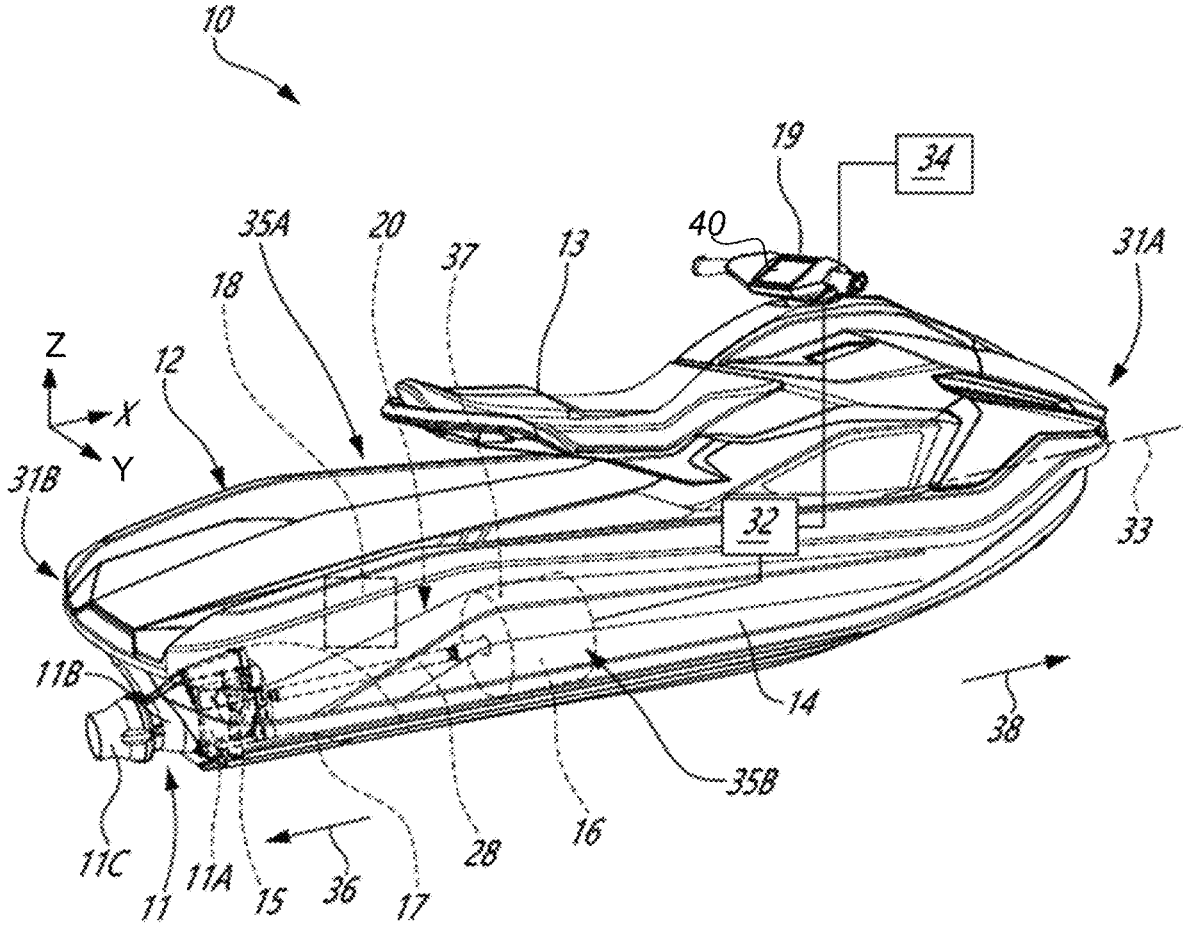
FIG. 1A is a perspective view of an example personal watercraft.

FIG. 1A illustrates an example of a watercraft 10 of a type used for transporting one or more passengers over a body of water. The watercraft 10 of FIG. 1A is electrically powered. An upper portion of the watercraft 10 is formed of a deck 12 including a straddle seat 13 for accommodating a driver of the watercraft 10 and optionally one or more passengers. A lower portion of the watercraft 10 is formed of a hull 14 which sits in the water. The hull 14 and the deck 12 enclose an interior volume 37 of the watercraft 10 which houses various components of the watercraft 10. A non-limiting list of components of the watercraft 10 that may be located in the interior volume 37 include an electric motor 16, one or more high-voltage (HV) electric batteries 18, a thermal management system, and other components for an electric drive system 20 of the watercraft 10. The hull 14 may also include strakes and chines which provide, at least in part, riding and handling characteristics of the watercraft 10. The interior volume 37 may also include any other components suitable for use with watercraft 10, such as storage compartments, for example.

Figure 1B:
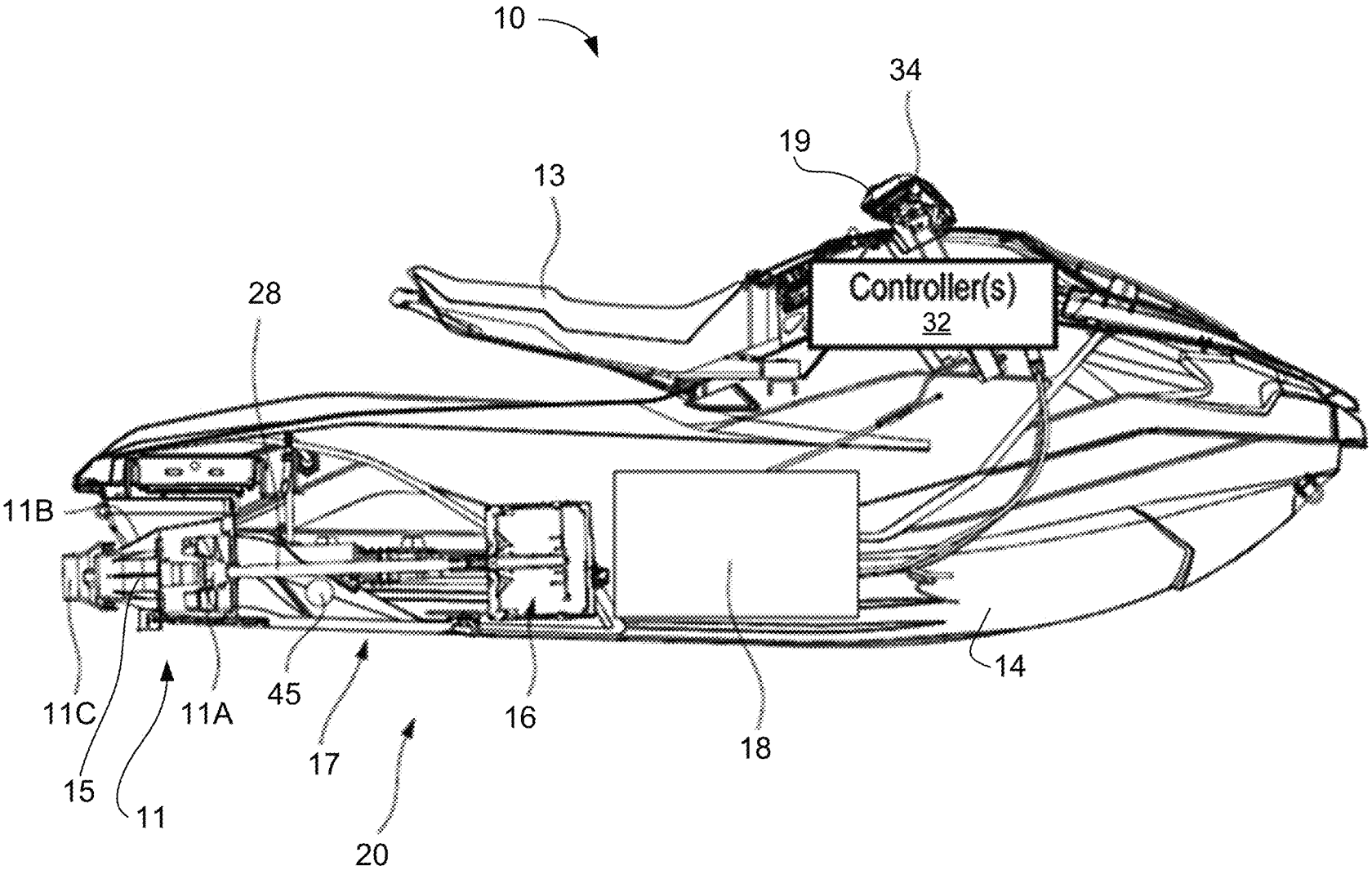
FIG. 1B is a side view of the example personal watercraft of FIG. 1A.

With additional reference to FIG. 1B, the watercraft 10 includes a jet propulsion system 11 to create a pressurized jet of water which provides thrust to propel the watercraft 10 through the water. The jet propulsion system 11 includes an impeller 15 disposed in the water to draw water through a water intake 17 on an underside of the hull 14, with the water being directed to a jet pump 11A. Water ejected from the jet pump 11A is directed through a venturi 11B which further accelerates the water to provide additional thrust. The accelerated water jet is ejected from the venturi 11B via a pivoting steering nozzle 11C which is directionally controlled (side to side) by the driver with a steering mechanism 19 to provide a directionally controlled jet of water to propel and steer the watercraft 10. The up and down positioning of the nozzle 11C is referred to herein as "nozzle trim", which may also be controlled via a trim actuator connected to the steering nozzle 11C, for example.

The electric drive system 20 of the watercraft 10 includes one or more of the electric motors 16 (referred hereinafter in the singular) drivingly coupled to the impeller 15 via a drive shaft 28. The drive shaft 28 transfers motive power from the electric motor 16 to the impeller 15. The electric drive system 20 also includes the HV batteries 18 (referred hereinafter in the singular) for providing electric current to the electric motor 16 and driving the electric motor 16. The operation of the electric motor 16 and the delivery of drive current to the electric motor 16 may be controlled by a controller 32 based on an actuation by the driver of an accelerator 34, sometimes referred to as a "throttle", on the steering mechanism 19, among other inputs. In some embodiments, the HV battery 18 may be a lithium ion or other type of battery 18. In various embodiments, the electric motor 16 may be a permanent magnet synchronous motor or a brushless direct current motor for example.

A user interface 40 may be provided, for example on the steering mechanism 19, and coupled to the controller 32. The user interface 40 may include rotary switches, toggle switches, push buttons, knobs, dials, etc. as well as a display screen for displaying various information to the driver and/or receiving input from the driver in the case of a touch-sensitive display screen. In some embodiments, the display screen of the user interface 40 may include a liquid crystal display (LCD) screen, thin-film-transistor (TFT) LCD screen, light-emitting diode (LED) or other suitable display device operatively connected to the controller 32.

With continued reference to FIG. 1A, the watercraft 10 moves along a rear or aft direction of travel 36 and along a forward direction of travel 38. The forward direction of travel 38 is the direction along which the watercraft 10 travels in most instances when displacing. The aft direction of travel 36 is the direction along which the watercraft 10 displaces only occasionally, such as when it is reversing. The watercraft 10 includes a bow 31A and a stern 31B defined with respect to the aft and forward directions of the travel 36, 38, in that the bow 31A is positioned ahead of the stern 31B relative to the forward direction of travel 38, and that the stern 31B is positioned astern of the bow 31A relative to the aft direction of travel 36. The watercraft 10 defines a longitudinal center axis 33 that extends between the bow 31A and the stern 31B. A port side 35A and a starboard side 35B of the watercraft 10 are defined on opposite lateral sides of the center axis 33. The positional descriptors "front", "aft" and "rear" and terms related thereto are used in the present disclosure to describe the relative position of components of the watercraft 10. For example, if a first component of the watercraft 10 is described herein as being in front of, or forward of, a second component, the first component is closer to the bow 31A than the second component. Similarly, if a first component of the watercraft 10 is described herein as being aft of, or rearward of, a second component, the first component is closer to the stern 31B than the second component. The watercraft 10 also includes a three-axes frame of reference that is displaceable with the watercraft 10, where the Z-axis is parallel to the vertical direction and defines heave and yaw (via rotation about the axis) of the watercraft 10, the X axis is parallel to the center axis 33 and defines surge and roll (via rotation about the axis) of the watercraft 10, and the Y-axis is perpendicular to both the X and Z axes and defines sway and pitch (via rotation about the axis) of the watercraft 10. Features and components are described and shown in the present disclosure in relation to the watercraft 10, but the present disclosure may also be applied to different types of watercraft 10, such as other boats or other vessels, used to transport people and/or cargo.

Watercraft 10 may include one or more sensors 45 operatively connected to various components of the watercraft 10, including the HV batteries 18, the motor 16, the nozzle 11C and the controller 32. Sensor(s) 45 may be configured to sense one or more operating parameters of these components for use by controller 32 for regulating the operation of the motor 16 and/or other components (e.g. nozzle 11C) of watercraft 10.

In some embodiments, sensor(s) 45 may include one or more current sensors and/or one or more voltage sensors operatively connected to HV battery 18 and/or connected to motor 16. Sensor(s) 45 may include one or more position sensors (e.g., rotary encoder) and/or speed sensors (e.g., tachometer) suitable for measuring the angular position and/or angular speed of a rotor of motor 16. Sensor(s) 45 may include one or more torque sensors (e.g., a rotary torque transducer) for measuring an output torque of motor 16. Alternatively or in combination therewith, the output torque of motor 16 may be inferred based on the amount of electric power (e.g., current) being supplied to motor 16, for example. Controller 32, may be configured to, using a motor controller and sensor(s) 45, control motor 16 to propel watercraft 10 based on commands received via accelerator 34.

The speed of watercraft 10 may be determined using a pitot tube or propellor submerged in the water. Alternatively or in addition, the speed of watercraft 10 may be determined using a satellite navigation device such as a global positioning system (GPS) receiver operatively connected to controller 32.

The hull 14 of the watercraft 10 is designed to cause the watercraft to operate in a displacement state, a planing state, and a semi-displacement or semi-planing state. At rest, the weight of the watercraft 10 is borne entirely by a buoyant force. At low speeds, the hull 14 acts as a displacement hull and the predominant forces acting on the watercraft hull are buoyancy forces (e.g. caused by the hull's displacement of water) and friction forces (e.g. caused by the movement of the hull through the water). The watercraft 10 is thus operating in a "displacement state". As speed increases, dynamic forces increase and the buoyancy forces decrease as the hull 14 lifts out of the water, decreasing the displaced volume. Beyond a given speed, the dynamic forces acting on the watercraft become the predominant upward force on the hull 14 and the watercraft 10 is said to operate in a "planing state".

Figure 2:
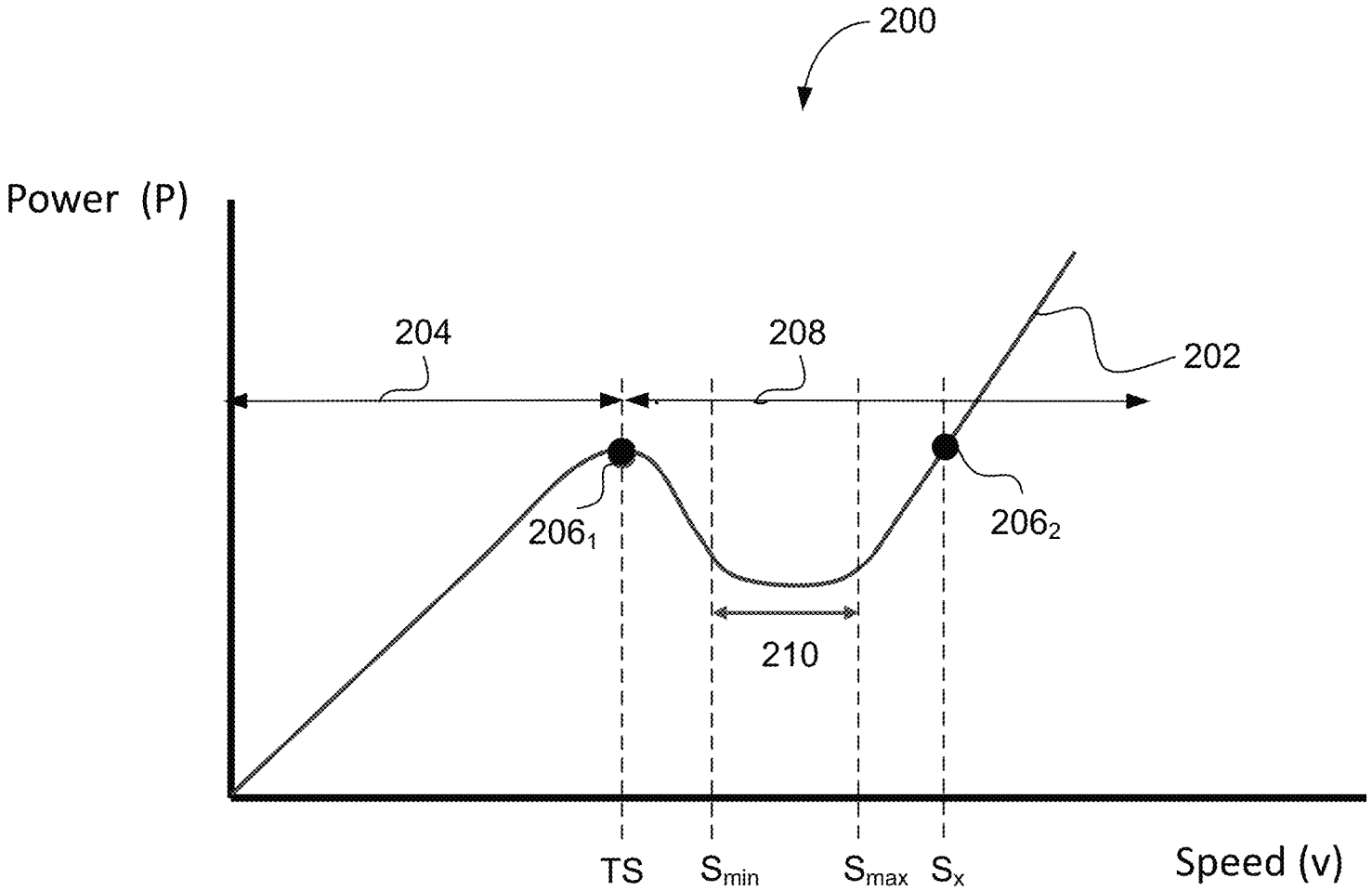
FIG. 2 is a graphical representation of speed vs power for a watercraft.

When the watercraft 10 is operating in a certain range of the planing state, less power is required from the motor 16 to displace the watercraft 10, as shown in the graph 200 of FIG. 2. Curve 202 represents power of the motor vs speed of the watercraft 10. The watercraft 10 is in the displacement and semi-displacement states at portion 204 of the curve 202, and in the planing state at portion 208 of the curve 202. The watercraft 10 transitions from the displacement state 204 to the planing state 208 at or around a transition point $\mathbf{206}_1$ of the curve 202, which corresponds to a transition speed TS. The transition to the planing state 208 occurs when, as a result of the shape of the hull and the watercraft speed, the nature of the forces acting on the watercraft 10 change. The dynamic forces are made up of lifting forces and resistance forces, and the total resistance consists of the horizontal component of the dynamic force and the friction resistance. As these dynamic forces increase, the lifting forces on the rear of the hull 14 cause the watercraft's attitude to change (i.e. the bow of the watercraft 10 starts to tilt downwards).

When the watercraft 10 is operating in the lowest part of the curve 202 within the planing state 208, identified as portion 210 of the curve 202, it is said to be operating in a range-efficient operating regime. The watercraft 10 reaches the range efficient operating regime 210 when the dynamic forces acting on the watercraft 10 provide a suitable lifting force to enable the watercraft 10 to achieve planing, while keeping the resistance forces low or to a minimum. This balance of dynamic forces acting on the watercraft 10 in the planing regime 208 within the range efficient operating regime 210 requires less power to propel the watercraft 10 than what is required at the upper end of the displacement regime 204, prior to reaching the transition point $\mathbf{206}_1$. As the watercraft speed continues to increase within the planing state 208, the magnitude of the dynamic forces increases, thus increasing the resistance forces acting on the watercraft hull 14 as well as the friction resistance. As a result, more power is required to overcome those resistance forces such that the watercraft 10 no longer operates in the range efficient operating regime 210. Another transition point $\mathbf{206}_2$ defines a speed $S_x$ after which the amount of power needed to match the desired speed is greater than the power needed when the watercraft is operating in the displacement state 204. However, the watercraft 10 may still be operating in the range efficient operating regime 210 since the power/speed ratio can still be low beyond transition point $\mathbf{206}_2$.

Throughout the range efficient operating regime 210, there is a natural attitude (i.e. watercraft trim) that is acquired by the watercraft 10 when the balance of lifting forces and resistance forces is improved or optimized. This natural attitude remains substantially constant over watercraft speeds associated with the range efficient operating regime 210 and the power consumption of the watercraft 10 is reduced, thus allowing a range of the battery 18, and watercraft 10, to be extended. The positioning of the watercraft nozzle 11C to define a nozzle attitude or angle (i.e. nozzle trim) will affect the balance of lifting and resistance forces acting on the watercraft 10 and thus plays a role in having the watercraft 10 operate in the range efficient operating regime 210. An optimal nozzle trim angle will minimize resistance forces on the watercraft 10 and allow the lifting forces to dominate. Moving the nozzle 11C away from the optimal trim angle will increase the resistance forces on the watercraft 10 and reduce the impact of the lifting forces, thus causing an increased amount of power to be needed to maintain the watercraft speed. To maximize range efficiency, it is desirable to have the watercraft nozzle trim angle be positioned near or at its optimal trim angle where the minimum amount of power is required to maintain the watercraft lift for a given watercraft speed.

In the example of FIG. 2, the range-efficient operating regime is obtained when the speed of the watercraft 10 lies between a minimum speed $S_{min}$ and a maximum speed $S_{max}$, after the speed has crossed the transition point $\mathbf{206}_1$ and entered the planing state 208. $S_{min}$ and $S_{max}$ define a range of speeds that correspond to the range-efficient operating regime of the watercraft. Some or all of this range of speeds is referred to herein as the optimal state of the speed parameter for the range-efficient operating regime, or the optimal speed for the range-efficient operating regime. In some embodiments, the optimal state includes all of the speed values between $S_{min}$ and $S_{max}$ (inclusive). In other embodiments, the optimal state is a single speed value or a subset of speed values between $S_{min}$ and $S_{max}$. It will be understood that $S_{min}$ and $S_{max}$ may be set as desired, up to and including speed TS and beyond speed $S_x$, and still take advantage of the benefits of operating in the range-efficient operation regime 210. It will also be understood that $S_{min}$ and $S_{max}$ need not be fixed values and may vary based on factors internal and/or external to the watercraft 10, as discussed in further detail elsewhere herein.

Figure 3:
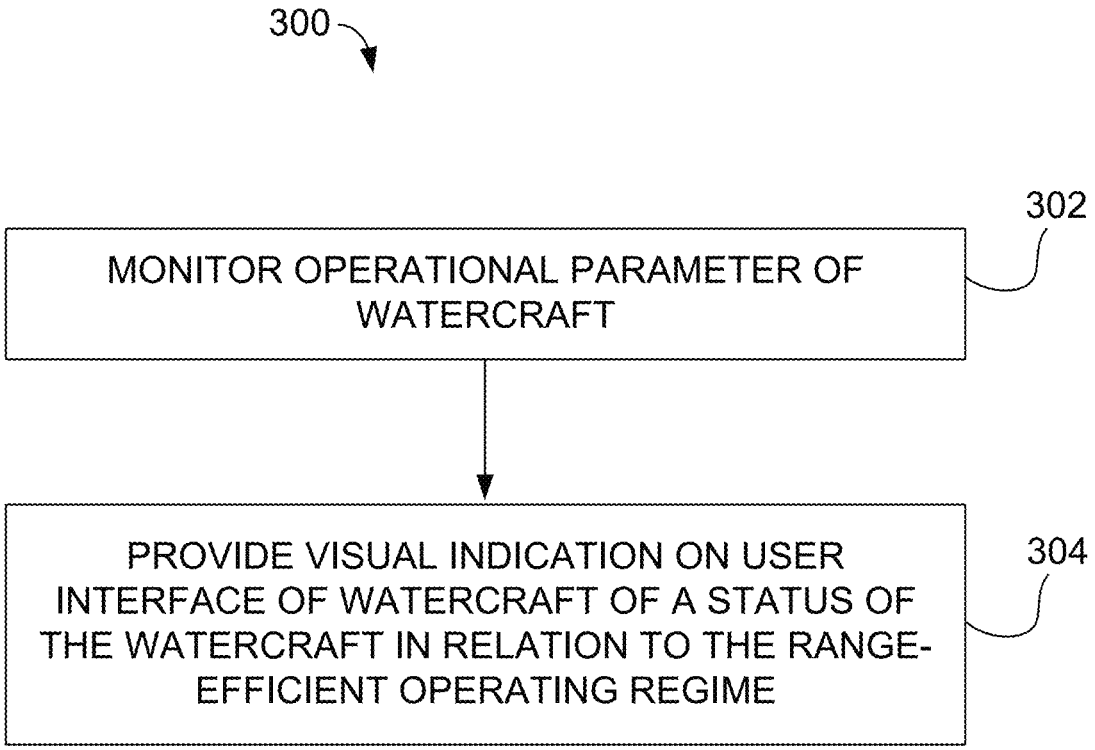
FIG. 3 is a flowchart of an example method for operating a watercraft.

In some embodiments, the watercraft 10 is designed and operated so as to provide the user with information regarding the range-efficient operating regime. An example method 300 for operating the watercraft 10 is shown in FIG. 3. In some implementations, the method 300 may be performed by the controller 32 of the watercraft 10. At step 302, an operational parameter of the watercraft 10 is monitored, the watercraft having a range-efficient operating regime following a transition of the watercraft from the displacement state to the planing state, and the operational parameter relating to the range-efficient operating regime. The operational parameter may have a range of values for which the watercraft operates in the range-efficient operating regime. At least some values within this range of values may correspond to an optimal state for the range-efficient operating regime. When the operational parameter is in its optimal state, the watercraft 10 is operating in the range-efficient operating regime. When the operational parameter is not in its optimal state, the watercraft might be operating outside of the range-efficient operating regime. However, it will be understood that the range of values corresponding to the range-efficient operating regime need not always be or include the optimal state of the operational parameter. The range of values might be selected or predicted to provide improved efficiency for the watercraft 10, but might not always provide the optimal efficiency.

The operational parameter may be a single parameter indicative of the watercraft 10 operating within or outside of the range-efficient operating regime, such as watercraft speed, motor rotational speed, or nozzle trim position. The operational parameter may be two or more parameters each having an impact on the watercraft's ability to operate in the range-efficient operating regime, such as watercraft speed and nozzle trim position, or motor rotational speed, watercraft speed and nozzle trim position. The operational parameter may be a ratio of two parameters, such as a power to speed ratio. The operational parameter may be a power efficiency of the motor, for example as obtained from a power efficiency map for motor rotational speed. The operational parameter may be a power efficiency of the watercraft 10, for example as obtained from a power efficiency map for watercraft speed.

Figure 4A:
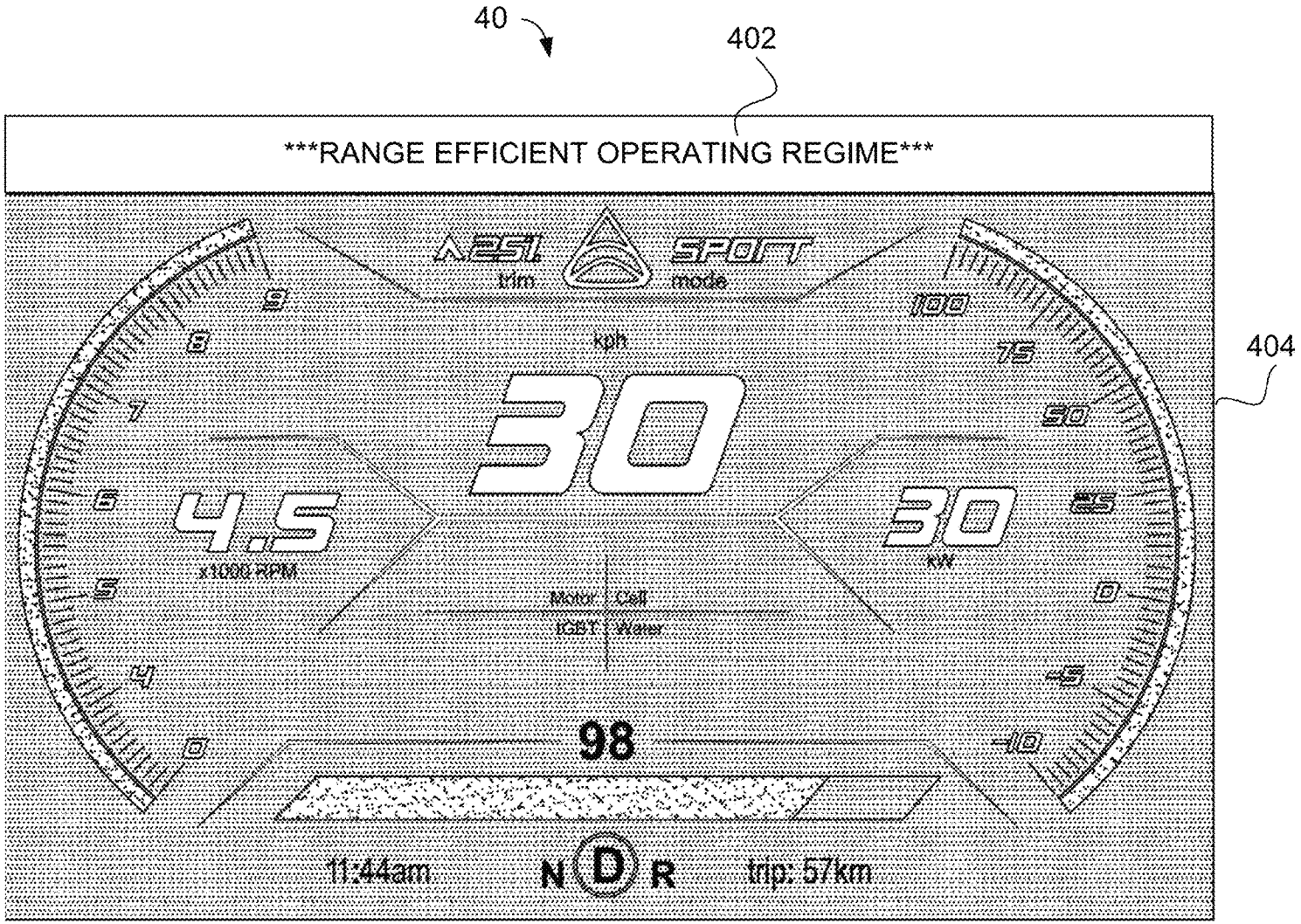
FIGS. 4A-4D are schematic diagrams illustrating example user interfaces of a watercraft.

At step 304, the method 300 comprises providing a visual indication on a user interface of the watercraft 10, such as user interface 40, of a status of the watercraft in relation to the range-efficient operating regime. Step 304 may be based, at least in part, on the monitored operational parameter. In some embodiments, when the operational parameter is within the range of values corresponding to the range-efficient operating regime, and optionally in its optimal state, then the visual indication may display a status indicative of being within the range-efficient operating regime. When the monitored operational parameter is outside the range of values corresponding to the range-efficient operating regime, then visual indication may display a status indicative of being outside the range-efficient operating regime. In this way, the visual indication informs the rider with regards to operation of the watercraft 10 within the range-efficient operating regime, and can take various forms. In some embodiments, the visual indication is binary, such that it is in a first state when the watercraft 10 is operating in the range-efficient operating regime and is in a second state when the watercraft 10 is not operating within the range-efficient operating regime. The first and second states may correspond to on and off, respectively, or may be represented using two active yet different formats. An example of a binary visual indication is shown in FIG. 4A, where a textual message 402 is displayed at the top of a display 404 of the user interface 40. In this case, the first state may be active when the message is displayed and the second state may be inactive when no message is displayed. Alternatively, the second state may cause the display of a different message, for example "outside of range efficient operating regime". Other examples of a binary visual indication are a light, an icon, or any other aspect of the user interface 40 that can be modified to provide a visual cue. For example, the background of the display 404 may change to a different color or change in intensity when the watercraft is operating in the range-efficient operating regime.

Figure 4B:
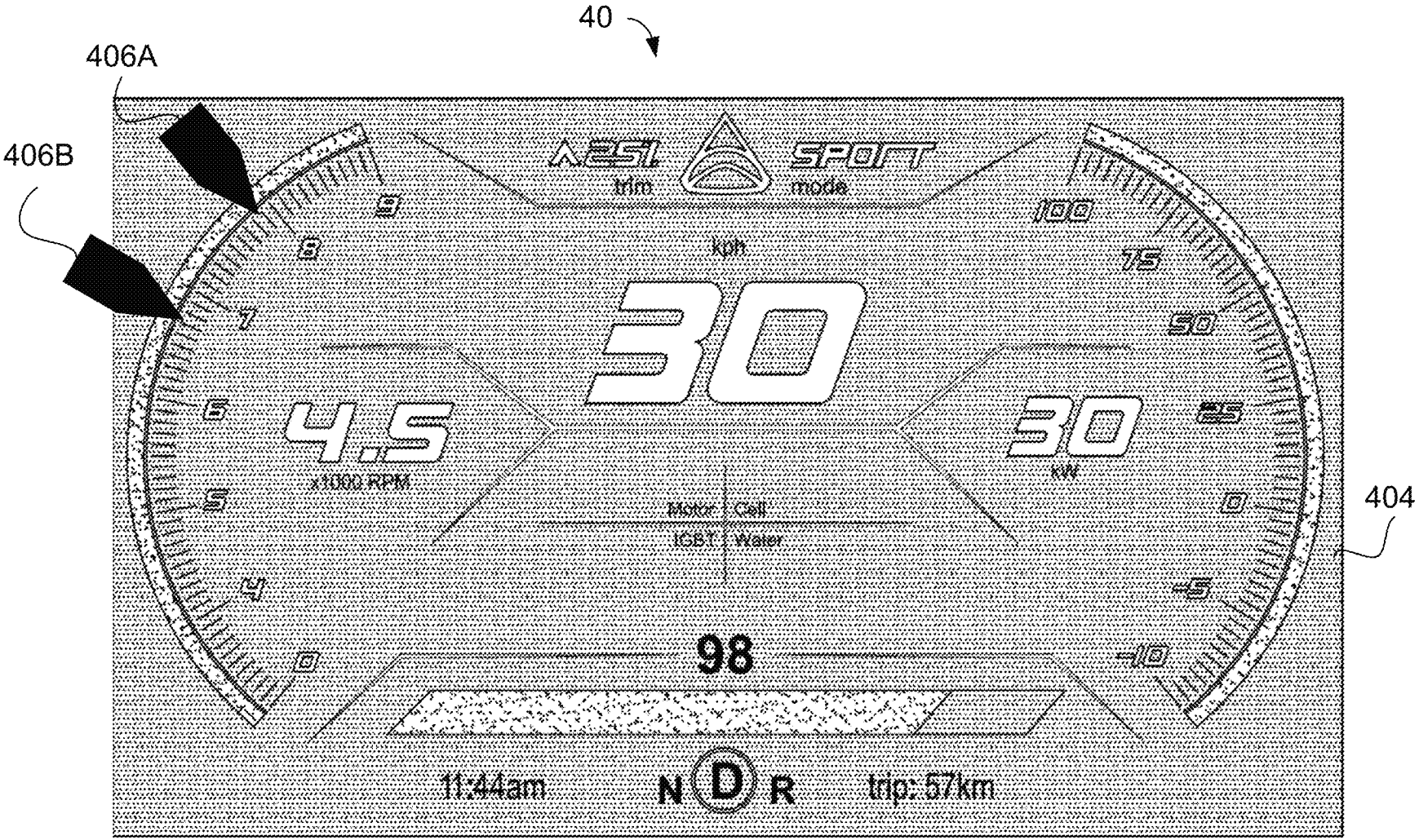

In some embodiments, the visual indication comprises one or more marker overlaid on the display 404 of the user interface 40. An example is illustrated in FIG. 4B, whereby first and second markers 406A, 406B are overlaid on the display 404 to indicate the range of motor speeds (e.g., angular speed in revolutions per minute (RPM)) that correspond to the range-efficient operating regime. In this example, the markers 406A, 406B are positioned on the tachometer of the display 404 to correspond to the upper and lower motor speed bounds $S_{max}$ and $S_{min}$, respectively, that define the range-efficient operating regime 210. The markers 406A, 406B may be static, and may be combined with another visual cue, such as a binary indicator, that gets triggered when the actual motor speed of the watercraft 10 falls within the range defined by the markers 406A, 406B. The one or more marker may be used with a parameter other than motor speed, such as but not limited to watercraft speed, power, nozzle trim position and the like.

Figure 4C:
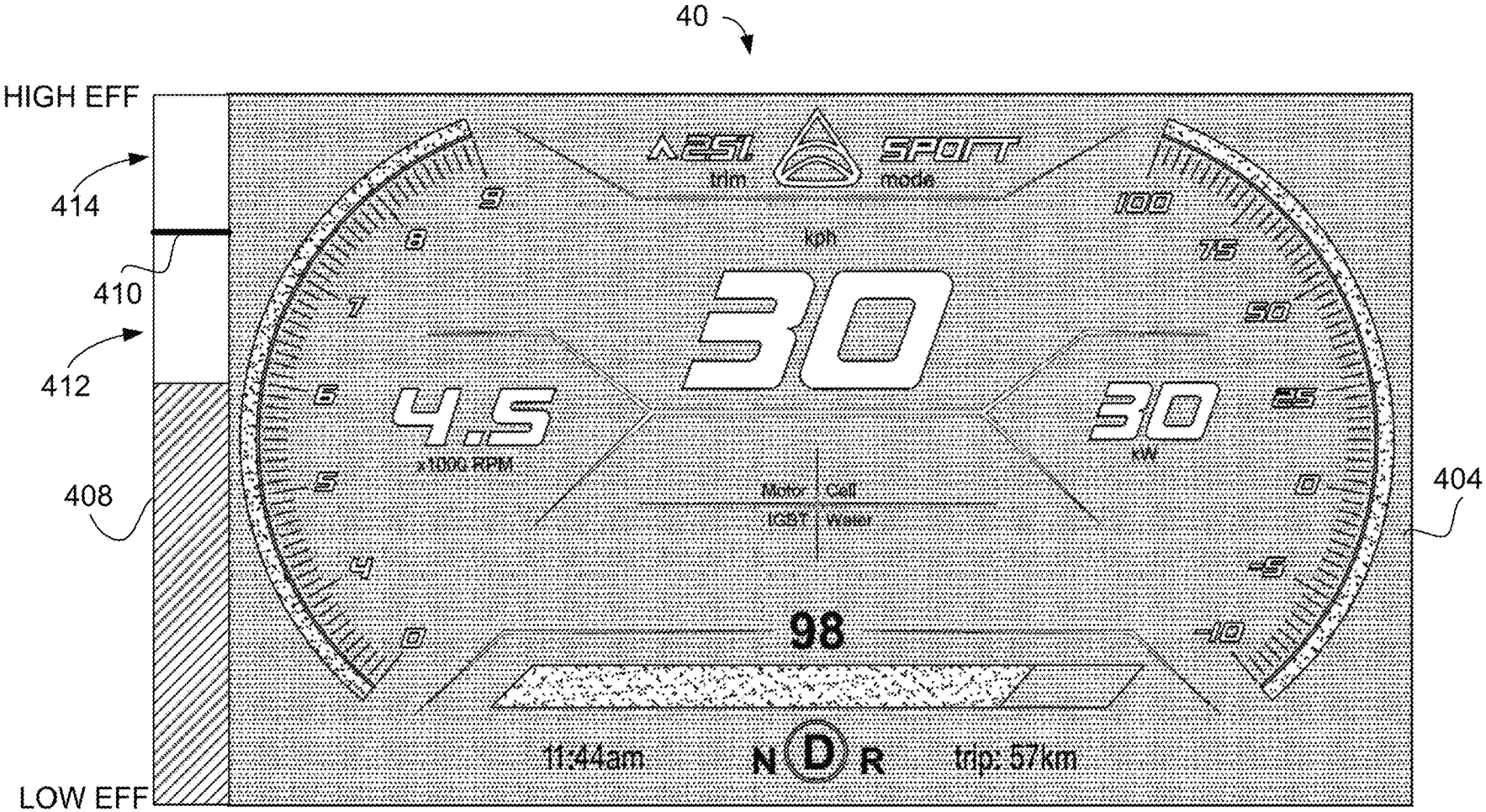

In some embodiments, the visual indication is dynamic and varies proportionally with the status of the watercraft 10 in relation to the range-efficient operation regime. An example is shown in FIG. 4C, where a graphical display 408 having a varying level is provided on the user interface 40. The level of the graphical display 408 varies dynamically as it rises with an increased watercraft efficiency and falls with a decreased watercraft efficiency. The level of the graphical display 408 may be determined by the controller 32 based on the operational parameter monitored at step 302. A marker 410 divides the display into a first region 412 and a second region 414. When the watercraft efficiency level is in the first region 412, the watercraft 10 is operating outside of the range-efficient operating regime. When the watercraft efficiency level is in the second region 414, the watercraft 10 is operating within the range-efficient operating regime. Using a dynamic indicator of this nature, the rider can observe a response in efficiency of the watercraft to a change in one or more controllable parameters of the watercraft 10, such as watercraft speed or nozzle trim position. The user can modulate the speed through the accelerator 34, or modulate the trim position of the nozzle 11C and observe directly the impact of the change in speed or trim position on the ability of the watercraft to operate in the range-efficient operating regime.

Figure 4D:
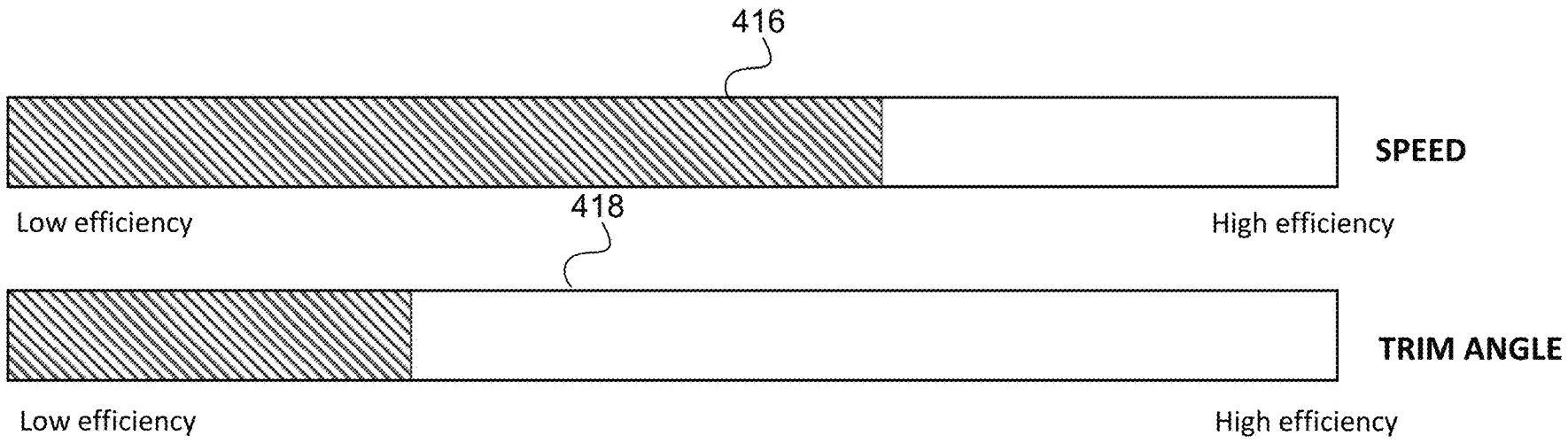

In some embodiments, the visual indication is dynamic and varies with one or more parameters of the watercraft 10, which may be the operational parameter that is monitored at step 302 but can also be another parameter. For example, the monitored operational parameter may be a power to speed ratio and the visual indication may be a graphical display that varies with the watercraft speed or that varies with RPM or that varies with power. An example is illustrated in FIG. 4D, where speed and trim angle (i.e. trim nozzle position) are both graphically displayed in relation to a respective optimal state for the range-efficient operating regime. A graphical speed display 416 varies with a change in speed of the watercraft 10 such that when the level of the display 416 tends toward the high efficiency end, the speed is closer to the optimal speed for the range-efficient operating regime then when the level tends toward the low efficiency end of the display 416. A graphical trim angle display 418 varies with a change in nozzle trim position such that when the level of the display 418 tends toward the high efficiency end, the trim angle is closer to the optimal position for the range-efficient operating regime than when the level tends toward the low efficiency end of the display 418. It will be understood that the visual indication may take various other forms, such as but not limited to a dial, a scale, a numerical value, a range of numerical values, and the like.

Figure 5:
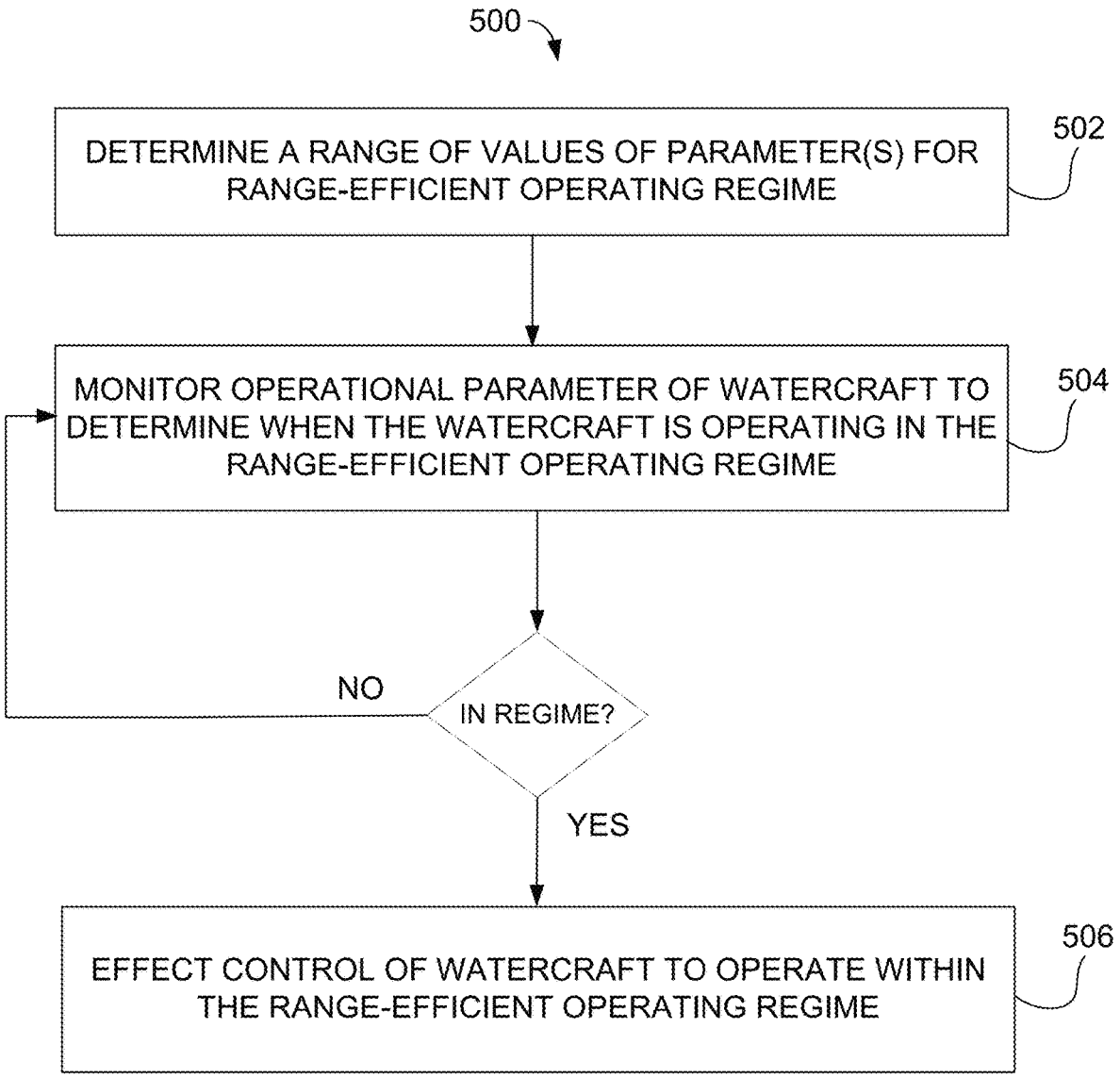
FIG. 5 is a flowchart of another example method for operating a watercraft.

In some embodiments, the watercraft 10 is designed and operated to effect a control on its operation in order to stay within the range-efficient operating regime, referred to herein as a "range efficiency control mode". An example method 500 for operating the watercraft 10 in the range efficiency control mode is shown in FIG. 5. The method 500 may be performed by the controller 32 of the watercraft 10. In some embodiments, a range of values (e.g., an optimal state) of one or more parameters for the range-efficient operating regime is determined at step 502. Step 502 may be omitted if the range of values or optimal state of the parameters for the range-efficient operating regime are predetermined, for example by being hard-coded into the system of the watercraft 10. Alternatively, there may be a plurality of different scenarios for the range-efficient operating regime. For example, the curve 200 as illustrated in FIG. 2 may change based on one or more factors, such as but not limited to environmental conditions of the watercraft, specifications of the motor (e.g. power rating, size, etc), specifications of the watercraft (e.g. size, type, etc), and the like. Examples of environmental conditions having an impact on the optimal state of the operational parameters for the range-efficient operating regime are loading of the watercraft, wind factor, water current, and water salinity. Any internal or external factor of the watercraft that affects the dynamic forces (i.e. the lifting forces and resistances forces) acting on the watercraft 10 may be taken into account in order to determine the optimal state of parameter(s) for the range-efficient operating regime.

In some embodiments, determining the range of values of the parameters in step 502 comprises selecting from a plurality of efficiency maps, based on one or more factor(s) affecting the dynamic forces. In some embodiments, determining the range of values of the parameters comprises selecting parameter values or ranges from a look-up table, based on one or more factor(s) affecting the dynamic forces. The factors may be user-selectable, for example through the user interface 40, or pre-selected. In some embodiments, the setting for each factor may be manually selected or entered through the user interface 40. For example, the user may be asked to select from a list of water types (i.e. fresh water, sea water) or to enter a value corresponding to water salinity. In another example, the user may be asked to select from a list of water current levels (e.g. low, medium, high) or to enter a value corresponding to a wind factor. Alternatively or in combination therewith, one or more of the sensor(s) 45 on the watercraft 10 may be used to determine the actual conditions of the watercraft. In this case, the controller 32 may be configured to receive sensor measurement(s) and determine the optimal state of the parameters for the range-efficient operating regime accordingly. For example, the controller 32 may be configured to select from the efficiency maps for the motor 16 based on the size of the motor and its rating. In another example, the controller 32 may be configured to select from the efficiency maps for the watercraft based on a current (i.e. actual) load of the watercraft 10.

At step 504, an operational parameter of the watercraft is monitored to determine when the watercraft is operating in the range-efficient operating regime. As stated above, the operational parameter may be any single parameter, group of parameters, ratio of parameters, efficiency, or a combination thereof indicative of the watercraft operating within or outside of the range-efficient operating regime, including but not limited to watercraft speed, motor rotational speed, nozzle trim position, power to speed ratio, power efficiency. In some embodiments, the parameter monitored at step 504 is the same as the parameter monitored at step 302 of the method 300. For example, the controller 32 may be configured to monitor the power to speed ratio in a closed loop fashion in order to continuously determine the optimal state of parameters for the range efficient operating regime, and to determine when the watercraft is operating in the range-efficient operating regime. The power drawn from the battery 18 and/or speed of the watercraft 10 may change depending on factors internal and/or external to the watercraft 10. Such changes would then be reflected in a change in the power to speed ratio of the watercraft 10, which could trigger a reassessment, by the controller 32, of the optimal state of parameters for the range-efficient operating regime.

When it is determined that the watercraft 10 is operating in the range-efficient operating regime, control of the watercraft is effected at step 506 in order to remain within the range-efficient operating regime, in accordance with the range efficiency control mode. In some embodiments, step 506 comprises applying a speed limit to the watercraft 10 or the motor 16 to prevent the speed from increasing to a point where it would exceed the upper bound associated with the range-efficient operating regime (i.e. $S_{max}$). In some embodiments, upper and lower speed limits are applied, to maintain the speed within $S_{min}$ and $S_{max}$. This allows the user to modulate the speed of the watercraft within $S_{min}$ and $S_{max}$ while preventing the speed from falling below $S_{min}$ and rising above $S_{max}$. In some embodiments, a cruise control function is activated for the watercraft 10 or the motor 16, such that the speed remains relatively constant. In some embodiments, step 506 comprises adjusting a trim angle of the nozzle 11C of the watercraft 10, so as to position the nozzle at its optimal position for the range-efficient operating regime. Both the speed and nozzle trim may be modified dynamically based on changing dynamic forces on the watercraft 10, such as changes in wind factor or in water current, for example.

In some embodiments, the method 500 is adapted to respond to a user input. For example, a user input may trigger the method 500 to begin, or a user input may cause the method to jump to step 506. A command to activate the range efficiency control mode can trigger the method 500 to begin at step 502. A command to enter (and maintain) the range-efficient operating regime can cause the controller 32 to automatically adjust the speed and/or trim angle in order to cause the watercraft to enter the range-efficient operating regime, thus allowing the condition needed to transition from step 504 to step 506 to be met. Therefore, user input may be used to enter the range-efficient operating regime, maintain the range-efficient operating regime, and/or exit the range-efficient operating regime.

Figure 6:
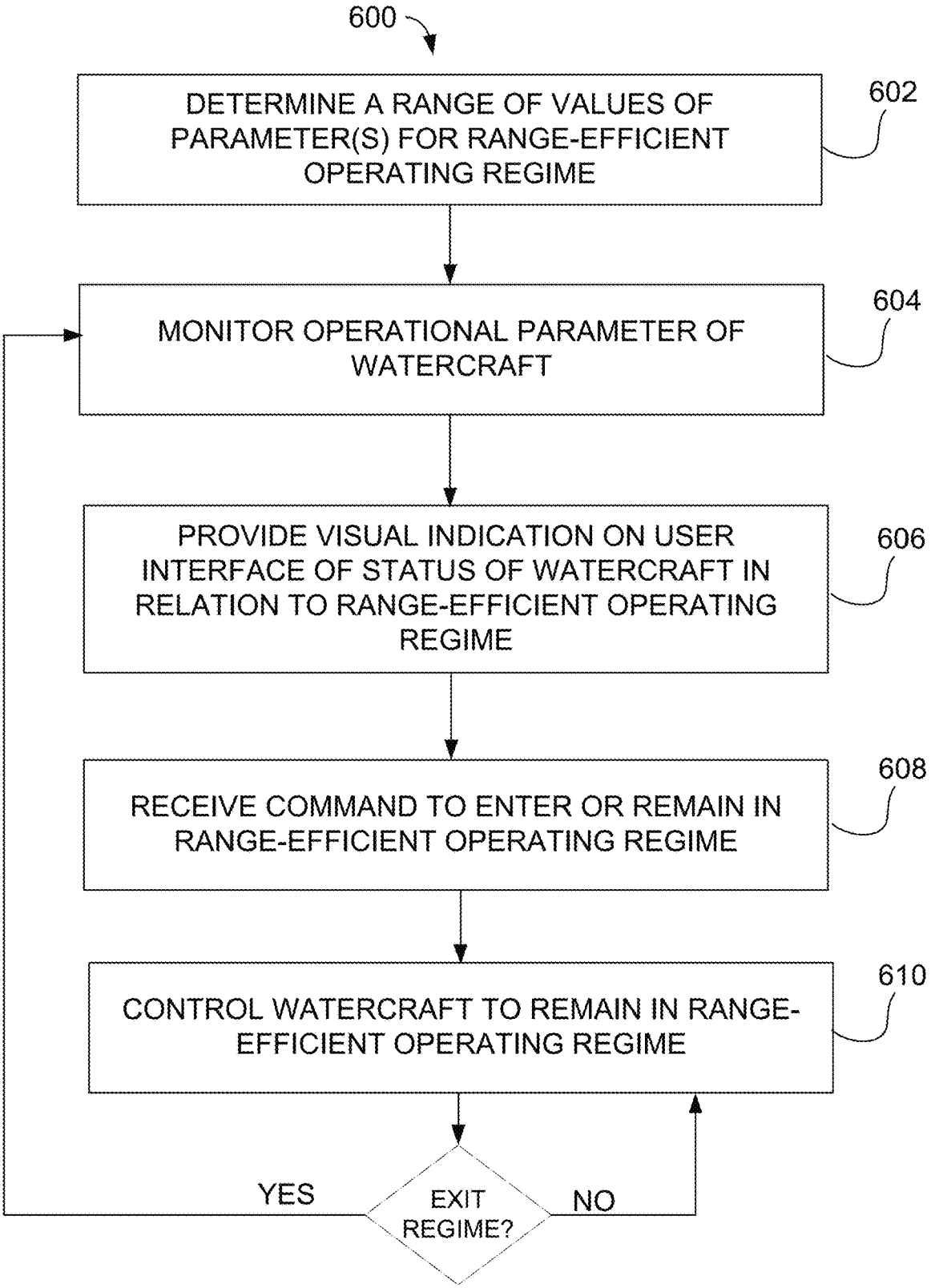
FIG. 6 is a flowchart of yet another example method for operating a watercraft.

The control mode, as performed by the controller 32 of the watercraft 10, may be combined in various manners with the features presented in the method 300, also performed by the controller 32. For example, the watercraft 10 may be designed and operated to provide a visual indication on the user interface 40 of the status of the watercraft in relation to the range-efficient operating regime, and the controller 32 may concurrently effect control on the watercraft to enter or remain with the range-efficient operating regime. An example method 600 for operating the watercraft 10 in this manner is illustrated in FIG. 6. At step 602, a range of values (e.g., the optimal state) of one or more parameters for the range-efficient operating regime is determined. Step 602 may be omitted if the range of values or optimal state of the one or more parameters is predetermined. At step 604, the operational parameter is monitored, in relation to its range of values. At step 606, a visual indication of the status of the watercraft in relation to the range-efficient operating regime is provided on the user interface 40, based on the operational parameter as monitored in step 604. Although shown as sequential, steps 604 and 606 may be performed concurrently, as the monitored parameter is used to determine the status of the watercraft in relation to the range-efficient operating regime, and the status is displayed on the user interface 40.

At step 608, a command is received by the controller 32 to remain or enter into the range-efficient operating regime. It will be understood that step 608 may be performed earlier in the method 600, for example prior to steps 604 or 606, or concurrently thereto. In some embodiments, the command is triggered upon start-up of the motor 16. In some embodiments, a dedicated user input is provided on the user interface 40, for example in the form of a button, a lever, a switch or a selectable input on a touch screen of a display, for the rider to manually activate the control mode. In some embodiments, a single user input is used to enter or remain in the mode, such that upon receipt of the command, the controller 32 is configured to determine whether or not the watercraft is currently operating in the range-efficient operating regime. Alternatively, separate user inputs are used, whereby a first dedicated input is associated with a command to enter the range-efficient operating regime and a second dedicated input is associated with a command to remain in the range-efficient operating regime.

At step 610, control of the watercraft 10 is effected in response to the command received at step 608. When the controller 32 determines that the watercraft 10 is operating outside of the range-efficient operating regime, or when the command received by the controller 32 is to enter the range-efficient operating regime, the controller 32 is configured to change one or more controllable parameters of the watercraft 10 or the motor 16 in order to cause the watercraft 10 to enter the range-efficient operating regime. For example, the controller 32 may increase or decrease the speed of the watercraft 10 and/or the RPM of the motor 16 to reach the optimal speed or optimal speed range associated with the range-efficient operating regime. The controller 32 may also change the position of the nozzle 11C to reach the optimal nozzle trim angle associated with the range-efficient operating regime. When the controller 32 determines that the watercraft 10 is operating within the range-efficient operating regime, or when the command received by the controller 32 is to remain within the range-efficient operating regime, the controller 32 is configured to maintain the controllable parameters of the watercraft 10 and/or the motor 16 at their optimal state so as to remain within the range-efficient operating regime. For example, an upper and/or lower speed limit may be applied to the watercraft 10 and/or motor 16, a cruise control function may be activated, and/or a nozzle position may be changed or locked so as to remain in an optimal state.

In some embodiments, step 610 comprises confirming the optimal state of the parameters for the range-efficient operating regime based on actual conditions. Confirmation may be performed continuously or punctually, using a regular or irregular frequency. For example, one or more sensor 45 of the watercraft 10 may be used to confirm certain watercraft conditions such as water salinity, wind factor, water current, and watercraft load. If a change is noted in any of the factors having an impact on the dynamic forces acting on the watercraft 10, the optimal state of parameters to meet these new conditions may be updated, and the controllable parameters of the watercraft may be modified in accordance with the updated optimal state. Presented more concretely, the range of speeds associated with the range-efficient operating regime may be 15 km/hr to 25 km/hr. Upon detecting a change in power to speed ratio, for example caused by an increase in water current, the controller 32 may update the range of speeds associated with the range-efficient operating regime to 18 km/hr to 28 km/hr. The speed control performed on the watercraft 10 or motor 16 is then also updated to reflect the new optimal speed range.

The controller 32 may continue to effect control on the watercraft 10 so as to remain within the range-efficient operating regime until receipt of a command to exit the control mode. The command may be triggered by a manual input from the rider, for example using the same or a different dedicated user input as that described above. In some embodiments, a same dedicated input is provided with three states as follows: (1) enter regime; (2) stay in regime; (3) exit regime, for example with a switch or lever having three distinct positions. Alternatively, two dedicated inputs are provided, a first one for entering and staying in the regime, a second one for exiting the regime. Also alternatively, three distinct dedicated inputs are provided. In some embodiments, the command to exit the regime is triggered in response to another user control, for example the accelerator 34 being displaced along a given distance, or a sudden change in speed greater than a threshold. The controller 32, in response to receiving the exit command, would exit the range efficient control mode and return to steps 604/606, whereby the operational parameter is monitored and the status in relation to the regime is displayed to the rider. Alternatively, the controller 32 may simply exit the mode and the method 600 would end until another command is received to enter or remain in the range-efficient operating regime. Any other mechanism for triggering the exit command may also be used.

Figure 7:
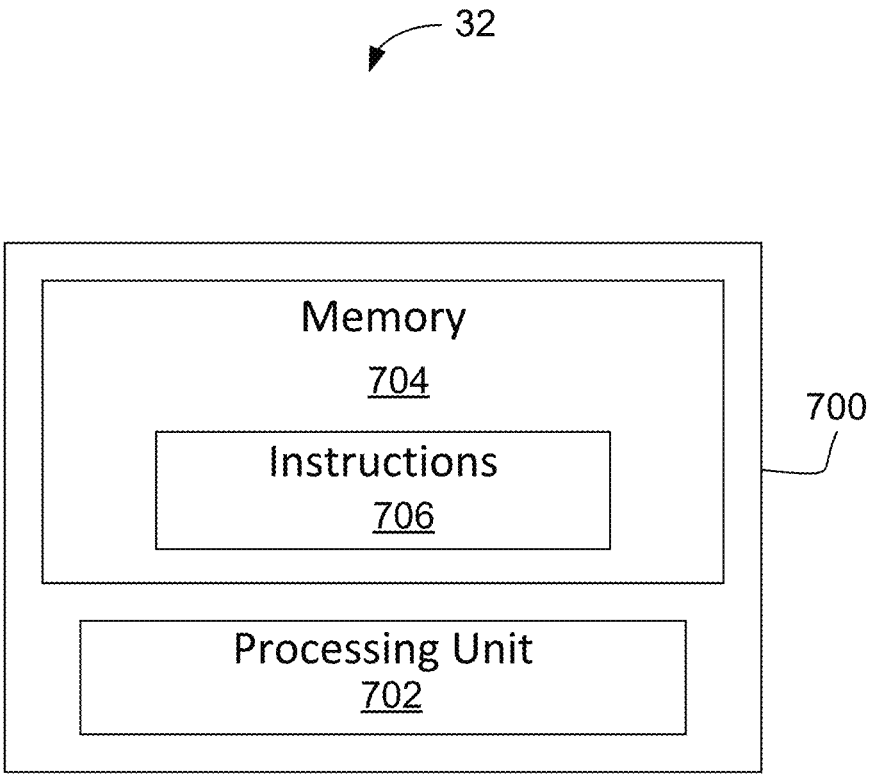
FIG. 7 is a block diagram of an example computing device.

Referring now to FIG. 7, an example embodiment for the controller 32 of the watercraft 10 is shown in detail. As illustrated, the controller 32 is embodied as a computing device 700. Although only one computing device 700 is shown for simplicity, multiple computing devices 700 operable to exchange data may be employed, as appropriate. The computing devices 700 may be the same or different types of devices. The computing device 700 comprises a processing unit 702 and a memory 704 having stored therein computer-executable instructions 706. The processing unit 702 may comprise any suitable devices configured to implement the functionality described herein, including the various methods described herein, such that instructions 706, when executed by the computing device 700 or other programmable apparatus, may cause the functions/acts/steps described herein to be executed. The processing unit 702 may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory 704 may comprise any suitable known or other machine-readable storage medium. The memory 704 may comprise non-transitory computer readable storage medium, for example, but not limited to, an electronic, magnetic, optical, electromagnetic, infrared, or semiconductor system, apparatus, or device, or any suitable combination of the foregoing. The memory 704 may include a suitable combination of any type of computer memory that is located either internally or externally to the computing device 700, for example random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. Memory 704 may comprise any storage means (e.g., devices) suitable for retrievably storing machine-readable instructions 706 executable by processing unit 702.

The methods and systems of the present disclosure may be implemented in a high level procedural or object oriented programming or scripting language, or a combination thereof, to communicate with or assist in the operation of a computer system, for example the controller 32. Alternatively, the methods and systems described herein may be implemented in assembly or machine language. The language may be a compiled or interpreted language. Program code for implementing the methods and systems described herein may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the methods and systems described herein may also be considered to be implemented by way of a non-transitory computer-readable storage medium having a computer program stored thereon. The computer program may comprise computer-readable instructions which cause a computer, or more specifically the processing unit 702 of the computing device 700, to operate in a specific and predefined manner to perform the functions described herein, for example those described in the methods 300, 500, 600.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments. The technical solution of embodiments may be in the form of a software product. The software product may be stored in a non-volatile or non-transitory storage medium, which can be a compact disk read-only memory (CD-ROM), a USB flash disk, or a removable hard disk. The software product includes a number of instructions that enable a computer device (personal computer, server, or network device) to execute the methods provided by the embodiments.

The embodiments described herein are implemented by physical computer hardware, including computing devices, servers, receivers, transmitters, processors, memory, displays, and networks. The embodiments described herein provide useful physical machines and particularly configured computer hardware arrangements. The embodiments described herein are directed to electronic machines and methods implemented by electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, and various hardware components. Substituting the physical hardware particularly configured to implement various acts for non-physical hardware, using mental steps for example, may substantially affect the way the embodiments work. Such computer hardware limitations are clearly essential elements of the embodiments described herein, and they cannot be omitted or substituted for mental means without having a material effect on the operation and structure of the embodiments described herein. The computer hardware is essential to implement the various embodiments described herein and is not merely used to perform steps expeditiously and in an efficient manner.

As can be seen therefore, the examples described above and illustrated are intended to be exemplary only. Various example embodiments are provided below.

Example embodiment 1. A watercraft comprising: a housing having a hull and a deck, the hull shaped to cause the watercraft to operate in a displacement state and a planing state; a powerplant in the housing; a propulsion device drivingly engaged to the powerplant to generate a propulsive force to propel the watercraft; a controller configured for monitoring an operational parameter of the watercraft, the watercraft having a range-efficient operating regime following a transition of the watercraft from the displacement state to the planing state, the operational parameter having an optimal state for the range-efficient operating regime; and a user interface coupled to the controller and configured for providing a visual indication of a status of the watercraft in relation to the range-efficient operating regime.

Example embodiment 2. The watercraft of example embodiment 1, wherein providing the visual indication of the status of the watercraft in relation to the range-efficient operating regime comprises displaying the monitored operational parameter in relation to the optimal state.

Example embodiment 3. The watercraft of example embodiments 1 or 2, wherein the operational parameter is a speed of the watercraft.

Example embodiment 4. The watercraft of example embodiments 1 or 2, wherein the powerplant is an electric motor and the operational parameter is a rotational speed of the electric motor.

Example embodiment 5. The watercraft of example embodiments 1 or 2, wherein the operational parameter is a power to speed ratio (PSR) for the watercraft.

Example embodiment 6. The watercraft of example embodiments 1 or 2, wherein the operational parameter comprises a first operational parameter and a second operational parameter, and wherein the first operational parameter is a speed of the watercraft and the second operational parameter is a trim angle of a nozzle of the propulsion device.

Example embodiment 7. The watercraft of any one of example embodiments 1 to 6, wherein the visual indication comprises at least one of a scale, a numerical value, and a dial.

Example embodiment 8. The watercraft of any one of example embodiments 1 to 6, wherein the visual indication comprises an indicator that is active when the watercraft is operating in the range-efficient operating regime and inactive when the watercraft is operating outside of the range-efficient operating regime.

Example embodiment 9. The watercraft of any one of example embodiments 1 to 6, wherein providing the visual indicator on the user interface comprises dynamically changing an aspect of the visual indicator proportionally with a change in efficiency of the watercraft.

Example embodiment 10. The watercraft of any one of example embodiments 1 to 9, wherein the controller is further configured for determining the optimal state for the operational parameter as a function of one or more factor internal or external to the watercraft.

Example embodiment 11. The watercraft of example embodiment 10, wherein the factor external to the watercraft comprises at least one of a loading of the watercraft, a wind factor, a water current, and a water salinity.

Example embodiment 12. The watercraft of any one of example embodiments 1 to 11, wherein the controller is further configured for controlling the operational parameter when the watercraft is operating in the range-efficient operating regime to remain within the range-efficient operating regime.

Example embodiment 13. The watercraft of example embodiment 12, wherein controlling the operational parameter comprises applying a speed limit or activating a cruise control function for the watercraft.

Example embodiment 14. The watercraft of any one of example embodiments 11 to 13, wherein controlling the operational parameter comprises adjusting a trim angle of a nozzle of the propulsion device.

Example embodiment 15. The watercraft of any one of example embodiments 1 to 14, wherein the powerplant is an electric motor.

Example embodiment 16. A method of operating a watercraft having a powerplant and a propulsion device drivingly engaged to the powerplant to generate a propulsive force to propel the watercraft, the watercraft having a hull shaped to cause the watercraft to operate in a displacement state and a planing state, the method comprising: monitoring an operational parameter of the watercraft, the watercraft having a range-efficient operating regime following a transition of the watercraft from the displacement state to the planing state, the operational parameter having an optimal state for the range-efficient operating regime; and providing a visual indication on a user interface of the watercraft of a status of the watercraft in relation to the range-efficient operating regime.

Example embodiment 17. The method of example embodiment 16, wherein providing the visual indication of the status of the watercraft in relation to the range-efficient operating regime comprises displaying the monitored operational parameter in relation to the optimal state.

Example embodiment 18. The method of example embodiments 16 or 17, wherein the operational parameter is a speed of the watercraft.

Example embodiment 19. The method of example embodiments 16 or 17, wherein the powerplant is an electric motor and the operational parameter is a rotational speed of the electric motor.

Example embodiment 20. The method of example embodiments 16 or 17, wherein the operational parameter is a power to speed ratio (PSR) for the watercraft.

Example embodiment 21. The method of example embodiments 16 or 17, wherein the operational parameter comprises a first operational parameter and a second operational parameter, and wherein the first operational parameter is a speed of the watercraft and the second operational parameter is a trim angle of a nozzle of the propulsion device.

Example embodiment 22. The method of any one of example embodiments 16 to 21, wherein the visual indication comprises at least one of a scale, a numerical value, and a dial.

Example embodiment 23. The method of any one of example embodiments 16 to 21, wherein providing the visual indicator on the user interface comprises activating an indicator when the watercraft is operating in the range-efficient operating regime and deactivating the indicator when the watercraft is operating outside of the range-efficient operating regime.

Example embodiment 24. The method of any one of example embodiments 16 to 21, wherein providing the visual indicator on the user interface comprises dynamically changing an aspect of the visual indicator proportionally with a change in efficiency of the watercraft.

Example embodiment 25. The method of any one of example embodiments 16 to 24, further comprising determining the optimal state for the operational parameter as a function of one or more factor internal or external to the watercraft.

Example embodiment 26. The method of example embodiment 25, wherein the factor external to the watercraft comprises at least one of a loading of the watercraft, a wind factor, a water current, and a water salinity.

Example embodiment 27. The method of any one of example embodiments 16 to 26, further comprising controlling the operational parameter when the watercraft is operating in the range-efficient operating regime to remain within the range-efficient operating regime.

Example embodiment 28. The method of example embodiment 27, wherein controlling the operational parameter comprises applying a speed limit or activating a cruise control function for the watercraft.

Example embodiment 29. The method of any one of example embodiments 26 to 28, wherein controlling the operational parameter comprises adjusting a trim angle of a nozzle of the propulsion device.

Example embodiment 30. The method of any one of example embodiments 16 to 29, wherein the powerplant is an electric motor.

Example embodiment 31. A watercraft comprising: a housing having a hull and a deck, the hull shaped to cause the watercraft to operate in a displacement state and a planing state; a powerplant in the housing; a propulsion device drivingly engaged to the powerplant to generate a propulsive force to propel the watercraft; and a controller configured for monitoring an operational parameter of the watercraft to determine when the watercraft is operating within the range-efficient operating regime, and upon determination that the watercraft is operating within the range-efficient operating regime, effecting control of the watercraft to maintain the watercraft within the range-efficient operating regime.

Example embodiment 32. The watercraft of example embodiment 31, wherein the controller is further configured for determining the optimal state for the operational parameter as a function of one or more factor internal or external to the watercraft.

Example embodiment 33. The watercraft of example embodiment 32, wherein the factor external to the watercraft comprises at least one of a loading of the watercraft, a wind factor, a water current, and a water salinity.

Example embodiment 34. The watercraft of any one of example embodiments 31 to 33, wherein effecting control of the watercraft to maintain the watercraft within the range-efficient operating regime comprises applying a speed limit or activating a cruise control function for the watercraft.

Example embodiment 35. The watercraft of any one of example embodiments 31 to 34, wherein effecting control of the watercraft to maintain the watercraft within the range-efficient operating regime comprises adjusting a trim angle of a nozzle of the propulsion device.

Example embodiment 36. The watercraft of any one of example embodiments 31 to 35, wherein the controller is further configured for receiving a command to enter the range-efficient operating regime and in response, effecting control of the watercraft to enter the range-efficient operating regime.

Example embodiment 37. The watercraft of any one of example embodiments 31 to 36, wherein the controller is further configured for receiving a command to exit the range-efficient operating regime and in response, cease effecting control of the watercraft to maintain the watercraft within the range-efficient operating regime.

Example embodiment 38. The watercraft of any one of example embodiments 31 to 37, wherein the controller is further configured for providing a visual indication of a status of the watercraft in relation to the range-efficient operating regime on a user interface of the watercraft.

Example embodiment 39. The watercraft of example embodiment 38, wherein providing the visual indication of the status of the watercraft in relation to the range-efficient operating regime comprises displaying the monitored operational parameter in relation to the optimal state.

Example embodiment 40. The watercraft of example embodiments 38 or 39, wherein the operational parameter is a speed of the watercraft.

Example embodiment 41. The watercraft of example embodiments 38 or 39, wherein the powerplant is an electric motor and the operational parameter is a rotational speed of the electric motor.

Example embodiment 42. The watercraft of example embodiments 38 or 39, wherein the operational parameter is a power to speed ratio (PSR) of the watercraft.

Example embodiment 43. The watercraft of example embodiments 38 or 39, wherein the operational parameter comprises a first operational parameter and a second operational parameter, and wherein the first operational parameter is a speed of the watercraft and the second operational parameter is a trim angle of a nozzle of the propulsion device.

Example embodiment 44. The watercraft of any one of example embodiments 31 to 43, wherein the powerplant is an electric motor.

The invention claimed is:

1. A watercraft comprising:

a housing having a hull and a deck, the hull shaped to cause the watercraft to operate in a displacement state and a planing state;

a powerplant in the housing;

a propulsion device drivingly engaged to the powerplant to generate a propulsive force to propel the watercraft;

a controller configured for monitoring an operational parameter of the watercraft, the operational parameter relating to a range-efficient operating regime of the watercraft following a transition of the watercraft from the displacement state to the planing state; and a user interface coupled to the controller and configured for providing a visual indication of a status of the watercraft in relation to the range-efficient operating regime based on the operational parameter, wherein:

the operational parameter has a range of values corresponding to the range-efficient operating regime, the range of values extending from a lower bound to an upper bound; and the visual indication indicates the status of the watercraft in relation to the lower bound and the upper bound.

2. The watercraft of claim 1, wherein at least some of the range of values of the operational parameter correspond an optimal state for the range-efficient operating regime.

3. The watercraft of claim 2, wherein the user interface is configured for displaying the monitored operational parameter in relation to the optimal state.

4. The watercraft of claim 1, wherein the operational parameter comprises a speed of the watercraft.

5. The watercraft of claim 1, wherein the powerplant comprises an electric motor and the operational parameter comprises a rotational speed of the electric motor.

6. The watercraft of claim 1, wherein the operational parameter comprises a power to speed ratio (PSR) for the watercraft.

7. The watercraft of claim 1, wherein the operational parameter comprises a first operational parameter and a second operational parameter, and wherein the first operational parameter is a speed of the watercraft and the second operational parameter is a trim angle of a nozzle of the propulsion device.

8. The watercraft of claim 1, wherein the visual indication comprises at least one of a scale, a numerical value, and a dial.

9. The watercraft of claim 1, wherein the visual indication comprises an indicator that is active when the watercraft is operating in the range-efficient operating regime and inactive when the watercraft is operating outside of the range-efficient operating regime.

10. A method of operating a watercraft having a powerplant and a propulsion device drivingly engaged to the powerplant to generate a propulsive force to propel the watercraft, the watercraft having a hull shaped to cause the watercraft to operate in a displacement state and a planing state, the method comprising:

monitoring an operational parameter of the watercraft, the operational parameter relating to a range-efficient operating regime following a transition of the watercraft from the displacement state to the planing state;

providing, based on the operational parameter, a visual indication on a user interface of the watercraft of a status of the watercraft in relation to the range-efficient operating regime, wherein:

the operational parameter includes a trim angle of a nozzle of the propulsion device; and the method includes adjusting the trim angle of the nozzle of the propulsion device when the watercraft is operating in the range-efficient operating regime to remain within the range-efficient operating regime.

11. The method of claim 10, wherein providing the visual indication of the status of the watercraft in relation to the range-efficient operating regime comprises displaying the monitored operational parameter in relation to a range of values of the operational parameter corresponding to the range-efficient operating regime.

12. The method of claim 11, further comprising determining the range of values for the operational parameter in relation to the range-efficient operating regime as a function of one or more factor internal or external to the watercraft.

13. The method of claim 12, wherein the factor external to the watercraft comprises at least one of a loading of the watercraft, a wind factor, a water current, and a water salinity.

14. The method of claim 10, wherein providing the visual indicator on the user interface comprises activating an indicator when the watercraft is operating in the range-efficient operating regime and deactivating the indicator when the watercraft is operating outside of the range-efficient operating regime.

15. The method of claim 10, wherein providing the visual indicator on the user interface comprises dynamically changing an aspect of the visual indicator proportionally with a change in efficiency of the watercraft.

16. The method of claim 10, comprising applying a speed limit or activating a cruise control function for the watercraft when the watercraft is operating in the range-efficient operating regime to remain within the range-efficient operating regime.

17. A watercraft comprising:

a housing having a hull and a deck, the hull shaped to cause the watercraft to operate in a displacement state and a planing state;

a powerplant in the housing;

a propulsion device drivingly engaged to the powerplant to generate a propulsive force to propel the watercraft; and a controller configured for monitoring an operational parameter of the watercraft to determine when the watercraft is operating within a range-efficient operating regime, and for effecting control of the watercraft to operate the watercraft within the range-efficient operating regime, effecting control of the watercraft including adjusting a trim angle of a nozzle of the propulsion device.

18. The watercraft as defined in claim 1, wherein the operational parameter includes a trim angle of a nozzle of the propulsion device.

* * * * *